US006523476B1

(12) United States Patent
Riess et al.

(10) Patent No.: US 6,523,476 B1
(45) Date of Patent: Feb. 25, 2003

(54) AMMUNITION WITH A SHELL WHOSE WALL CONSISTS OF COMBUSTIBLE OR CONSUMABLE WOUND BODY

(75) Inventors: Heinz Riess, Fürth (DE); Erich Muskat, Roth (DE)

(73) Assignee: Dynamit Nobel GmbH Explosivstoff und Systemtechnik, Troisdorf (DE)

( * ) Notice: Subject to any disclaimer, the term of this patent is extended or adjusted under 35 U.S.C. 154(b) by 0 days.

(21) Appl. No.: 09/830,627

(22) PCT Filed: Oct. 16, 1999

(86) PCT No.: PCT/EP99/07862

§ 371 (c)(1),
(2), (4) Date: Jul. 20, 2001

(87) PCT Pub. No.: WO00/26604

PCT Pub. Date: May 11, 2000

(30) Foreign Application Priority Data

Oct. 29, 1998 (DE) ..... 198 49 824

(51) Int. Cl.[7] ..... F42B 5/18
(52) U.S. Cl. ..... 102/431; 102/467
(58) Field of Search ..... 102/430–433, 102/439, 464–467, 700

(56) References Cited

U.S. PATENT DOCUMENTS 2,837,456 A * 6/1958 Parilla ..... 102/431
3,304,867 A * 2/1967 Nadel
3,348,445 A 10/1967 Nadel
3,706,279 A * 12/1972 Zimmerman ..... 102/700
3,745,927 A * 7/1973 Tanner et al.
3,977,325 A * 8/1976 Jacobsen ..... 102/465
4,202,270 A * 5/1980 Luther et al. ..... 102/431
5,048,421 A * 9/1991 Swartout
5,243,914 A * 9/1993 Penner ..... 102/431
5,323,707 A * 6/1994 Norton et al. ..... 102/431
5,544,587 A * 8/1996 Thiesen et al. ..... 102/700
5,563,365 A * 10/1996 Dineen et al. ..... 102/431

FOREIGN PATENT DOCUMENTS

DE 305157 * 7/1920
DE 2424900 5/1974
FR 2488390 * 2/1982

* cited by examiner

*Primary Examiner*—Harold J. Tudor
(74) *Attorney, Agent, or Firm*—Antonelli, Terry, Stout & Kraus, LLP

(57) ABSTRACT

The invention aims at improving the quality of ammunition having a shell whose wall consists of a combustible or consumable wound body with at least one double layer of crossed threads. The wound body (1) forms a single piece. The winding density of the wound body (1) varies along the length of the wound body (1) so that distribution of the threads (3) optimally matches the charge of the shell (12).

11 Claims, 5 Drawing Sheets

AMMUNITION WITH A SHELL WHOSE WALL CONSISTS OF COMBUSTIBLE OR CONSUMABLE WOUND BODY

BACKGROUND OF THE INVENTION

The invention relates to ammunition having a case, the wall of which consists of a combustible or consumable wound package with at least one double layer of intersecting filaments, with said filaments being impregnated or coated with a binding agent and with a end socket containing the detonating charge being connected to the wound package.

Ammunition with a case, the wall,of which consists of a combustible or consumable wound package with at least one double layer of intersecting filaments which are impregnated or coated with a binding agent, is known from DE-OS 2 424 900. According to this publication the individual filament layers exhibit a homogeneous structure with respect to the deposition of the filaments. There is no description of the adaptation of the projectile and of the end socket to the wound package of the case.

From U.S. Pat. No. 3,348,445 it is known to develop the propellent charge out of filaments that have previously been produced from a powder mixture, the explosive substance. The powder mixtures are, for example, dissolved in acetone and shaped by spinnerets into filaments, dried and subsequently wound up. In this process the winding is not restricted to just a few layers, but instead complete coils are wound. The latter may not only be inserted into traditional cases as propellent charge, they may even form the body of the ammunition. How the projectile is inserted into these wound bodies is neither represented nor described.

SUMMARY OF THE INVENTION

The object of the present invention is to present ammunition having a combustible or consumable wound body, the filaments in the windings being deposited optimally over the length of the wound body in a manner that is matched to the variable possible loadings and to the desired burn-up behaviour.

This object is achieved by making the wound package in one piece and by virtue of a changing deposition of filaments over the length of the wound package, the density of winding of the wound package is being variable, matching the loading of the case.

The wound body according to the invention is in one piece. The projectile is inserted at the case mouth of said wound body, the adaptation region for the projectile, and at its other end said wound package bears a end socket with the detonating charge. By reason of the one-piece design, the separate production of the case halves and a process step for the assembly of the case halves are advantageously dispensed with.

In accordance with the invention the filaments are deposited unevenly over the length of the wound package. The density of winding, that is to say the number of times the filament or filaments is/are deposited over the length of the wound body, is matched to the actual and possible loadings and also to the desired burn-up behaviour. The greater, for example, the pressure loading on a case in one region, the greater the number of deposited filaments is chosen to be in this region The density of winding is influenced substantially by the angle of intersection. With an intersecting deposition of the filaments on the periphery of the wound body the angle of intersection is the angle between two filaments running towards one another in the direction of deposition in a so-called double layer. A double layer consists of a layer of filaments which have been deposited in the direction towards one end of the wound package and of the overlying layer of filaments which have been deposited in the opposite direction, in the direction towards the other end of the wound body. Since the filaments oil the periphery of the wound bodies are deposited in helical manner in the direction of the longitudinal axis of the ammunition, the pitch of the deposition determines the angle of intersection. with a small pitch, the angle of intersection is likewise small; with a large pitch it is likewise large. The strength and load-carrying capacity of a wound package, as well as its burn-up behaviour, are additionally influenced by the method of winding. for instance, one filament can be wound alone, or several filaments running in parallel with a slight spacing from one another can be wound to form a wound package.

In an advantageous further development of the invention the angle of intersection of the filaments of the wound body in the adaptation region for the projectile and in is the adaptation region for the end socket is smaller than in the intermediate region of the wound body. The variable loadings within the wall of the case are taken into consideration by this change in the angles of intersection. Increased tensile and pressure loadings arise, in particular, in the adaptation regions for projectile and end socket. The wound body becomes more stable within the range of small angles of intersection, particularly in relation to pressure loadings in the radial direction. In the central region of the case, tensile loading predominates. This is taken into account there by virtue of a larger angle of intersection of the filaments.

In a further refinement of the invention, the angles of intersection in the adaptation region of the projectile can be smaller than in the adaptation region of the end socket. For example, the tank ammunition projectile has a mass of several kilograms. In order that the projectile is held securely in the case, the wall of the case has to have an appropriate load-carrying capacity. This is obtained by virtue of a denser deposition of filaments than in the remaining part of the wound body, that is, by a smaller spacing of the filaments which are deposited alongside one another, with a smaller angle of intersection. The end socket loads the wound body less than the projectile does. By reason of the flow conditions in the combustible gases, the burn-up behaviour of the wound body is slower in the adaptation region of the end socket than in the remaining region of the case. The burn-up behaviour can be improved by virtue of so-called pores, the unfilled interstices between the filaments. Pores arise if the winding of the filaments is less dense, that is to say with larger angles of intersection and with larger spacings of the filaments which are deposited alongside one another. The angles of intersection may, for ammunition of calibre 120 mm for example, be distributed over the wound body as follows: in the adaptation region of the projectile approximately between 15° and 30°, in the adaptation region of the end socket approximately between 30° and 50°, and in the central region of the wound body up to 90°. However, the invention is not intended to be restricted to these gradations or to the stated limiting values. The angles of intersection are to be matched to the calibre and to the intended use of the ammunition and hence substantially to the diameter and the length of the case.

Compression of the wound body at its respective ends, the adaptation regions, can be effected by lowering the angle of intersection in single-stage or multi-stage steps. However, a continuous decrease in the angle of intersection in the direction towards the respective adaptation regions can also be obtained by controlling the deposition of the filaments. The tensile and pressure loadings of the case are made uniform with a wound body that has been built up in this way.

Influence can be exerted not only on the load-carrying capacity of the case but also on its burn-up or consumption behaviour through the choice of the angles of intersection. Thus in a wound package that consists of several double layers the angles of intersection in the respective double layers may differ from one another. In order to assist, in particular, the effect of the propellant charge in the course of burn-up, it can be advantageous if the wall is structured in the radial direction in such a way that by virtue of the presetting of small angles of intersection, the outermost layers are able to withstand a higher pressure loading than the inner layers. By this means, a higher resistance is set against the radial deformation of the case in the course of burn-up of the propellant charge, so that the effect of the propellant charge on the projectile in the axial direction is assisted.

A particularly high strength of a layer of the wound package is obtained when the filaments are interwoven with one another, at least within a double layer. The individual filament layers, also in a double layer in the walls of a case that are built up from intersecting layers of the filaments, are situated above one another separately. With a method of deposition of the filaments that is different from the method of winding known from textile technology, the filaments can be interwoven with one another, whereby the angle of intersection may also differ from 90° as is conventional in woven fabrics. The braiding pattern can be matched to the loading of the case and also to the burn-up behaviour of the wound package. The walls of the cases, the wound bodies of which have a structure consisting of filaments that have been interwoven with one another, have a particularly high strength and are therefore suitable, in particular, for large projectiles, for example for tank ammunition.

In order to accelerate and consequently to assist the burn-up or consumption of the wound package, an explosive substance can be admixed to the binding agent with which the filaments are impregnated or coated. In another refinement of the invention the interspaces between the filaments and the filament layers can also be filled at least partially with an explosive substance. The unfilled interspaces between the filaments and the individual filament layers form pores and can be utilised for the purpose of assisting the combustion or consumption of the wound package. The oxygen of the trapped air in the residual pores assists the combustion. In addition, the pores offer a surface of attack for the propellant gases, accelerating the burn-up or the consumption. The term 'burning' in this context means that the constituents of the wound package actively participate in the combustion process. The term 'consuming filaments' is to be understood to mean those filaments which predominantly decompose in the course of the combustion of the propellant charge to form gaseous substances and/or to form finely dispersed particles. Suitable materials for the filaments and compositions of the propellants and binding agents are known from DE 38 25 581 C1.

By reason of the method of winding it is possible to control the deposition of the filaments in such a way that, in particular, the adaptation regions for the projectile or the end socket, are shaped in such a way that simple assembly of the ammunition is possible. The adaptation region for the projectile, a flange-shaped thickening, for example, can be formed in particular at the mouth of the case. In the course of the assembly of an initially disassembled projectile, this thickening needs only, for example, to be clamped between the parts and in this way enables an exactly fitting and firm seating of the projectile.

Moreover, it is possible to produce a case that is suitable for receiving projectiles of variable type and size. Adaptation can be effected with such a configuration by means of a matching piece, a projectile-receiving adapter, that is capable of being integrated into the wound package, that is to say is already placed, for example, on the winding mandrel in the course of production of the wound package and is wound over.

The shaping of a thickening at the mouth of the case for the purpose of securing a projectile body in the course of producing the wound package is possible in straightforward manner by additional filament layers being deposited at the mouth of the case. Deposition of the filaments can be effected most simply by the filaments being deposited, predominantly parallel to one another, onto the end of the wound package that is already present. Deposition of the filaments in a slightly intersecting layer can also be effected to the extent that it is possible by reason of the technical circumstances. The case wall and the thickening can consequently be produced integrally. In order to guarantee an optimal accuracy of fit in the course of insertion of the projectile and insertion of the end socket, a machining of the wound package, for example grinding or stripping, may be required in the adaptation regions.

The end socket can be adhesion-bonded to the wound package or mechanically connected to it using one of the known joining methods. The end socket is constructed in such a way that the end region of its cylindrical wall is provided for the purpose of securing the wound package. The end socket is pushed into the wound package together with this part. The remaining part of the end socket is configured in such a way that it contains a sealing ring, with which a leakage of gas, that is to say an emission of the propellant gases counter to the direction of transport of the projectile past the bottom of the case, is prevented. One or more sealing rings may be provided depending on the calibre and the size of the propellant charge.

BRIEF DESCRIPTION OF THE DRAWINGS

The invention will be elucidated in more detail on the basis of exemplifying embodiments.

DETAILED DESCRIPTION OF THE PREFERRED EMBODIMENTS

Figure 1:
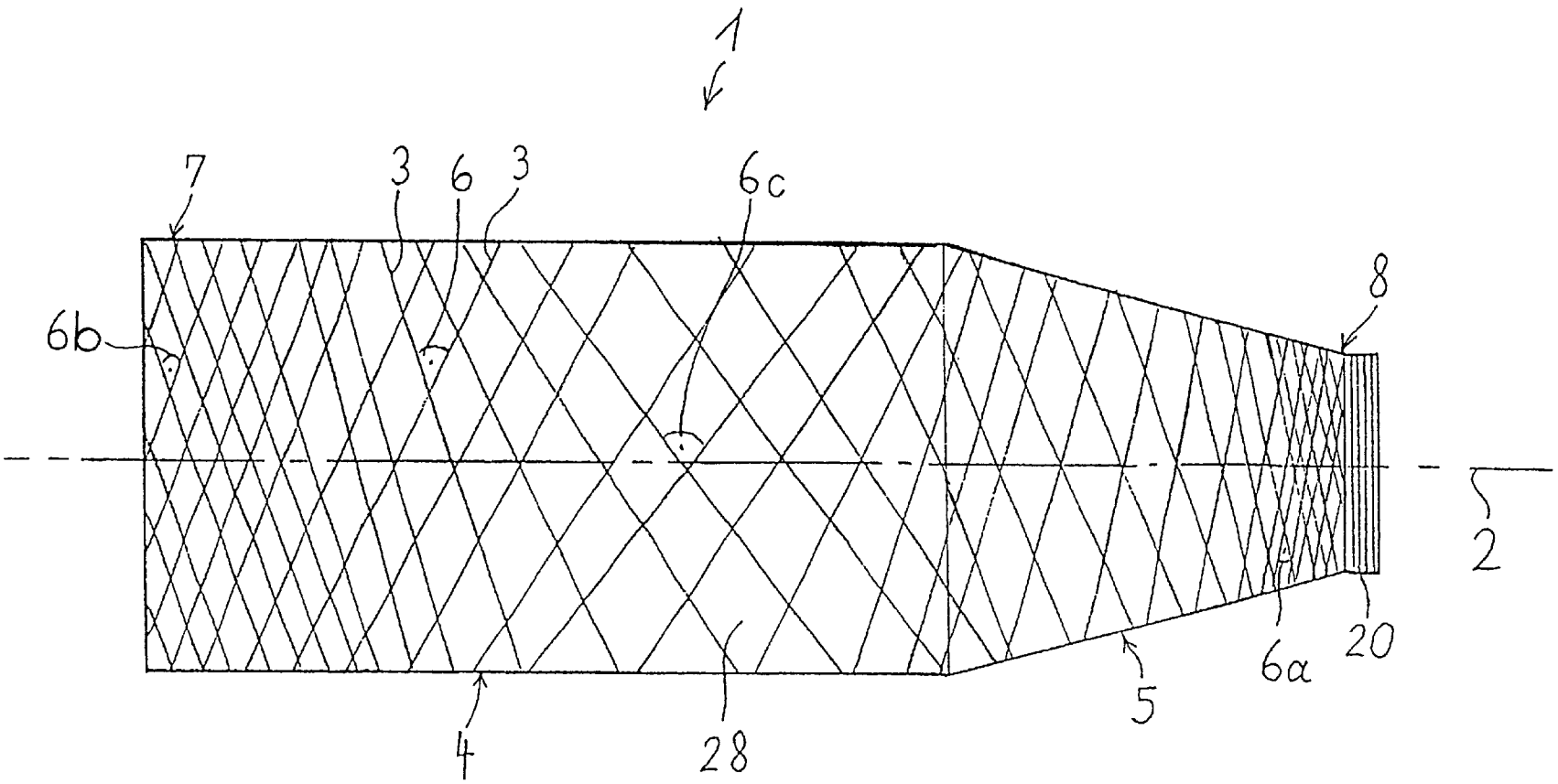
FIG. 1 shows the view of a wound package according to the invention with changing angle of intersection of the filaments over the length of the wound package, in particular in the adaptation regions for the projectile and the end socket.

FIG. 1 shows a wound package 1 in a simplified, schematic representation. It is part of the case of an item of large-calibre ammunition, not fully represented here, of calibre 120 mm for example. The wound package 1 is rotationally symmetrical with respect to the axis 2 of the ammunition. In the present exemplifying embodiment it is constructed from double layers of intersecting filaments 3. The wound package 1 has a cylindrical part 4 and a conical part 5. The cylindrical part 4 substantially encases the propellant charge; the conical part 5 receives the projectile.

The view of the wound package 1 shows that the angles of intersection 6 over its length are of variable magnitude. The filaments 3 have been wound with variable pitches. If the filaments 3 are wound with a small pitch they intersect with an acute angle of intersection 6*a* or 6*b*. This winding structure is preferred, in particular, in the end regions 7 and 8 of the wound package 1, for example in the adaptation region 7 for the end socket, which is not represented here, with angles of intersection 6*b* of approximately 40°, and in the adaptation region 8 for the projectile, which is not represented here, for example with angles of intersection 6*a* of approximately 20°. In these regions, the wound package 1 is exposed to more considerable loads as a result of the securing of the end socket or the projectile. The increased number of filaments 3, as well as their alignment in the course of deposition, increases the compressive strength of the wall of the case, of the wound package 1, in these regions. The angles of intersection 6*c* are larger, here around 75°, particularly in the central region of the cylindrical part 4 because the pitch of the deposited filaments is also greater. The interstices 28 between the filaments 3 become larger. They may continue to exist as pores or may be filled at least partially with explosive substance. The tensile strength of the wound package in the direction of the axis 2 of the ammunition increases with increasing angle of intersection. An optimal structure of the wound package can be obtained which is matched to the loadings and to the burn-up in the individual regions by presetting the angle of intersection, that is to say by virtue of the pitch of the filaments, which is preset in the given case, in the course of deposition. At the mouth of the case, in the adaptation region 8 for the projectile, a thickening 20 of the wound package 1 is provided, for example in the form of a flange which is utilised for the purpose of securing the projectile within the case.

Figure 2:
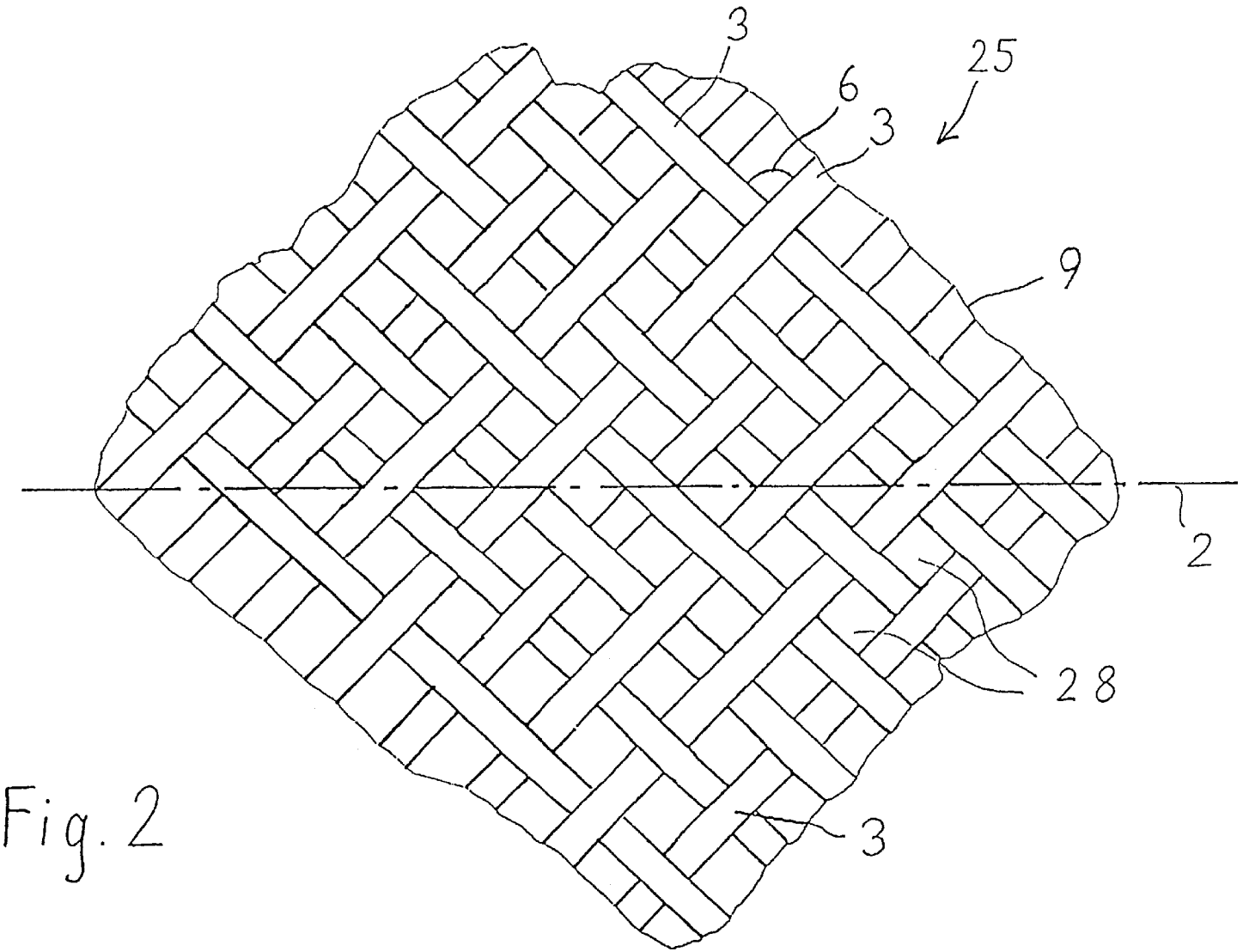
FIG. 2 shows the view of a double layer of a wound package, in which the filaments are interwoven with one another.

FIG. 2 shows a detail from a wound package 1 in which the filaments 3 are interwoven with one another within a double layer 25. The angle of intersection 6 amounts in the present exemplifying embodiment to 90°, as in a woven fabric. The interstices 28 of the braided network 9 may continue to exist as pores or may be filled at least partially with explosive substance. As a result of the degree of interweaving of the filaments 3 with one another, both the radial and the axial strengths increase by reason of the increased friction of the filaments against one another. The density of the braided network 9 also has an influence on the strength. Wound bodies with this structure can be employed advantageously, for example, in ammunition with thin-walled cases and in large-calibre ammunition. Instead of individual filaments 3, several filaments situated closely alongside one another can also be interwoven with one another. In ammunition having a calibre of 120 mm, for example, nine filaments side by side, which form a small band with a width of approximately 25 mm, can be deposited with a pitch of 100 mm in the course of one revolution of the wound package in order to generate the winding pattern that is shown.

Figure 3:
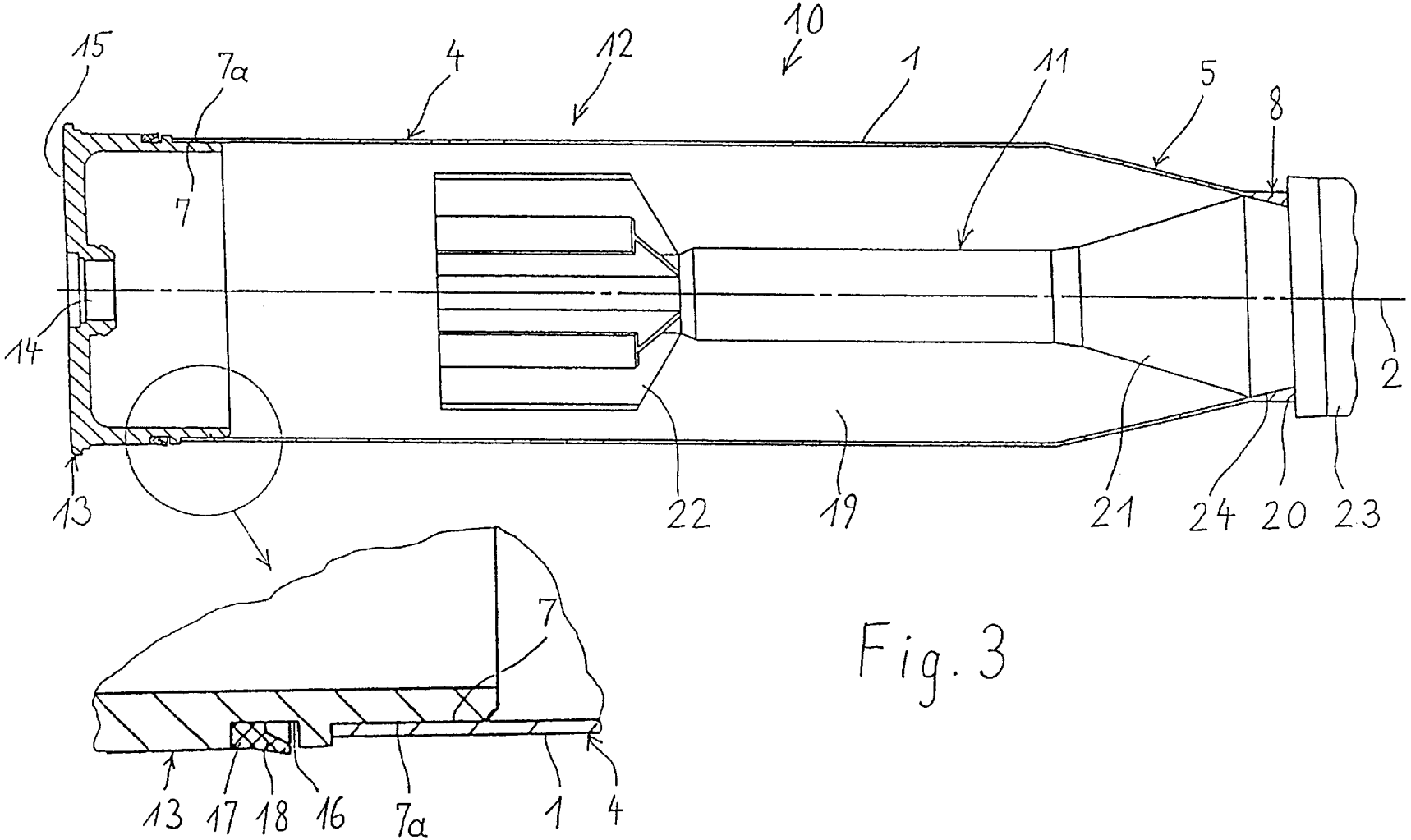
FIG. 3 shows a section through a shell with a flange-shaped thickening at the mouth of the case for the purpose of securing a projectile, as well as an adhesive bond between the wound package of the case and the end socket which bears a sealing ring.

FIG. 3 shows a section through an item of artillery ammunition 10 with a practice round 11. The complete case 12 consists of the wound package 1 and the end socket 13 with the detonator 14. The end socket 13 consists of metal, solid plastics or some other combustible material. The end socket 13 with its adaptation region 7*a* has been pushed into the adaptation region 7 of the wound package 1 and has been adhesively-bonded there to the wound package 1. The connection of wound package and end socket is once again represented as a unit on an enlarged sale. Below the adaptation region 7*a,* in the direction of the base 15 of the case, there is located a groove 16 in which a sealing ring 17 is inserted. This sealing ring may be made of plastics. It possesses a sealing lip 18 which is directed radially outwards in the firing direction and which is intended to serve for gas sealing.

The interior space 19 of the case is filled with a part of the practice round 11 and, not shown here, with the propellent charge. In the conical part 5 of the wound package 1 in the adaptation region 8 for the projectile 11 is provided a thickening of the mouth of the case in the form of a flange 20. The practice round 11 is inserted prior to the filling of the interior space 19 of the case 12 with the propellent charge and prior to the adhesion bonding of the end socket 13. The practice round 11 is capable of being disassembled into at least two parts, into a lower part 21 with the stabilizing fins 22 and a head 23. The head 23 is capable of being screw-coupled to the lower part 21 or capable of being connected thereto in another form. Firstly the lower part 21 is pushed sufficiently far into the case for the conical edge 24 to bear against the wound package 1 in the adaptation region 8. The head 23 is screwed on until it firmly abuts the flange 20 As a result, the practice round 11 with its conical edge 24 is fixed in the adaptation region 8 within the case 12 by means of a force fit.

Figure 4:
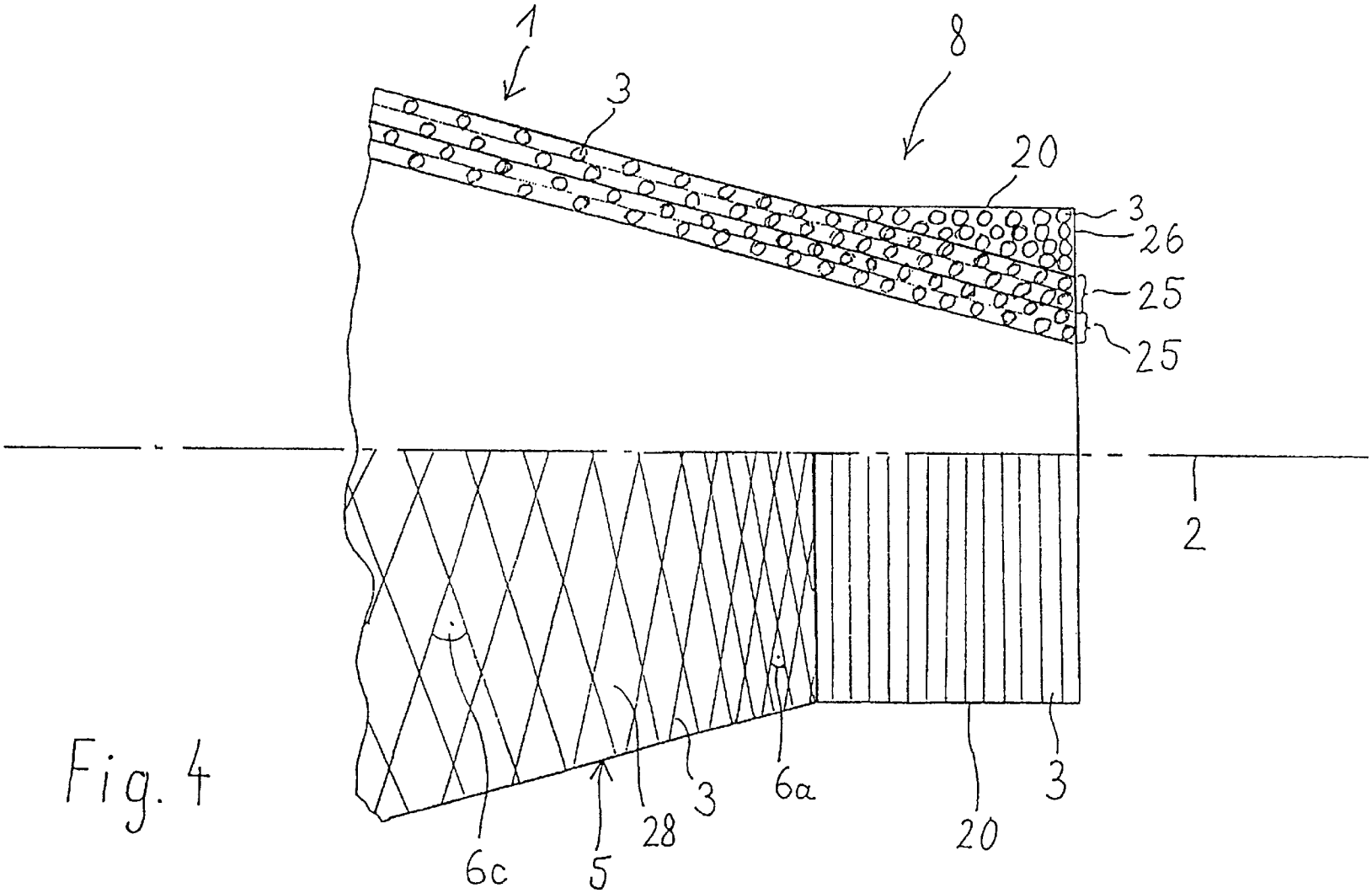
FIG. 4 shows in the form of a detail, the structure of the thickening of the mouth of the case, in view and in section

FIG. 4 shows, in the form of a detail on an enlarged scale, the conical part 5 of the wound package 1 with the adaptation region 8 for the projectile, partially in section. Below the axis 2 a top view of a double layer 25 of the wound package 1 can be seen. The angles of intersection of the intersecting filaments 2 decrease in the direction of the adaptation region 8 of the projectile from the greater angle of intersection 6*c* to the smaller angle of intersection 6*a*. Hence the number of filaments increases in the adaptation region 8. The flange 20 displays a virtually parallel winding of the filaments 3. The wound package 1 is sectioned above the axis 2. For the sake of clarity, only two double layers 25 are represented here. Each layer of filaments 3 is situated above another. The covering or impregnation of the filaments with a binding agent is not represented, nor is the filling-up of the gaps 28 between the filaments with explosive substance. The flange 20 has been formed as a thickening on the end of the conical part 5 by virtue of additional superimposed filament layer 26 extending virtually in parallel. After the production of the wound package, a remachining, particularly in the adaptation regions 7 and 8, can be effected, for example by stripping or grinding of the surfaces, in order to create clean and smooth adherent or bearing surfaces.

Figure 5:
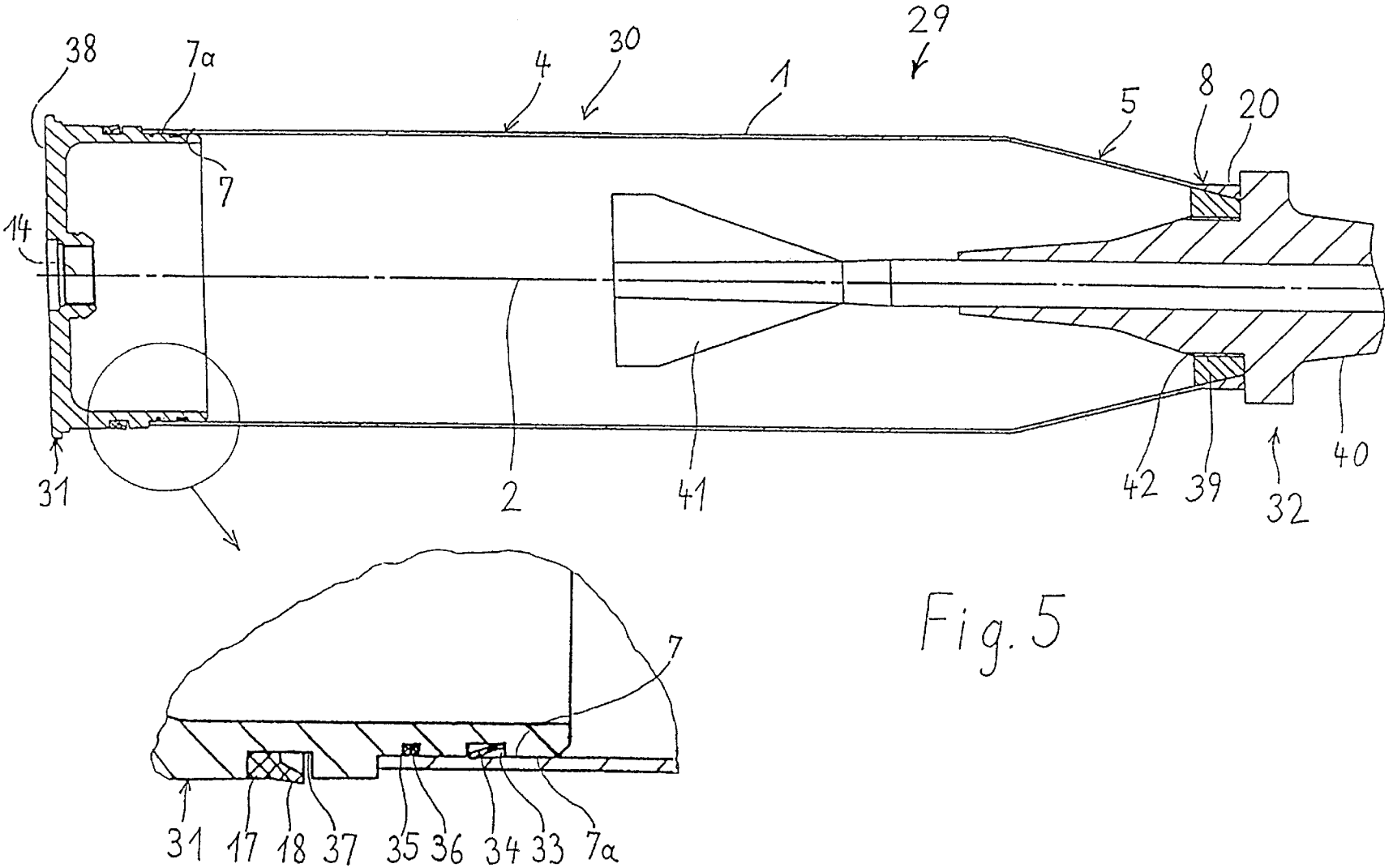
FIG. 5 shows a section through a shell with an adapter for securing a projectile, as well as a non-positive connection between the wound package of the case and the end socket.

A further example of an item of artillery ammunition 30 is represented in FIG. 5. Features corresponding to those of the preceding embodiment example are designated by the same reference numerals. Correspondence exists with respect to the preceding embodiment example as regards the configuration of the wound package 1. Differences exist with respect to the configuration of the end socket 31 as well as the configuration of the projectile 32, which in the present exemplifying embodiment is a warhead.

In the present exemplifying embodiment the end socket 31 is connected to the wound package 1 by means of a force connection. Here too, the connection of wound package and end socket has once again been represented in the form of a detail on an enlarged scale. A clamping ring 34 which establishes the force connection between wound package 1 and end socket 31 is inserted in a first groove 33 in the adaptation region 7*a* of the end socket 31. A sealing ring 36, for example an O-ring made of rubber, is located in a second groove 35 situated in the direction towards the end of the wound package in order to protect the propellent charge against moisture. Outside the adaptation region 7*a* on the end socket 31 there is located, in a manner comparable with the preceding embodiment example, a groove 37, in which likewise is inserted a sealing ring 17 with sealing lip 18 which is intended to serve for gas sealing. The detonator 14 is inserted in the base 38 of the end socket.

In contrast to the preceding exemplifying embodiment, incorporation of the warhead 32 into the wound package 1 is effected by means of a projectile-receiving adapter 39. This projectile-receiving adapter 39 is integrated into the wound package already in the course of production of the wound package 1. To this end, the projection-receiving adapter is pushed onto the mandrel on which the wound package is produced, and is covered with the filament layers. Assembly of the warhead 32 is effected in such a way that the upper part 40 of the warhead 32 is firstly inserted into the wound package 1 without the stabilizing fins 41. In this process the connection to the projectile-receiving adapter 39 can be effected, for example, by adhesion bonding or, as in the present exemplifying embodiment, by a screw connection. To this end, a thread 42 is provided in the projectile-receiving adapter 39 and also on the upper part of the warhead 32. When the upper part 40 of the warhead 32 is screwed in, the upper part 40 is applied to the end 20 of the mouth of the case, which is thickened in the form of a flange, and exerts on the conically shaped projectile-receiving adapter 39 a force acting in the direction of the conically tapering part 5 of the wound part 1, so that a reliable retention of the warhead 32 is effected by virtue of the clamp fit of the projectile-receiving adapter 39. Only after the insertion of the upper part 40 of the warhead 32 are the stabilizing fins 41 attached by screws, the interior space 19 of the case filled with the propellent charge, and the end socket 31 inserted.

What is claimed is:

1. Ammunition, comprising:

a case comprising a combustible or consumable wound package having an adaptation region for a projectile at a first end, an adaptation region for an end socket at a second end and a wall including at least one double layer of intersecting filaments, the filaments being impregnated or coated with a binding agent; and an end socket containing a detonating charge connected to the adaptation region for the end socket at the second end of the wound package;

wherein the wound package is in one piece and a density of winding of the wound package is varied over a length of the wound package to match a loading of the case, the density of winding being determined by an angle of intersection of the filaments in the at least one double layer, angles of intersection of the filaments of the wound package being smaller in the adaptation region for a projectile and the adaptation region for the end socket than angles of intersection of the filaments in remaining regions of the wound case.

2. Ammunition according to claim 1, wherein the angles of intersection of the filaments in the wound package decrease continuously in directions of the adaptation region for a projectile and the adaptation region for the end socket.

3. Ammunition according to claim 1, wherein the wound package comprises several double layers and wherein angles of intersection of the filaments in the respective double layers differ from one another.

4. Ammunition according to claim 1, wherein the filaments form a braided network within each double layer of the wound package.

5. Ammunition according to claim 1, wherein the binding agent includes an explosive substance admixed therein.

6. Ammunition according to claim 1, wherein interstices between the filaments are filled at least partially with an explosive substance.

7. Ammunition according to claim 1, wherein the adaptation region for a projectile has a flange at the first end into which a projectile body can be force fit.

8. Ammunition according to claim 7, wherein the flange comprises a thickening of the wound package formed from additional filament layers deposited predominantly parallel to one anther on the wound package.

9. Ammunition according to claim 1, further comprising at least one sealing ring arranged concentrically in relation to an axis of the ammunition on the end socket outside the adaptation region for the end socket.

10. Ammunition according to claim 1, further comprising a projectile connected to the adaptation region for a projectile of the wound package, at least a part of the projectile extending within the case.

11. Ammunition according to claim 10, further comprising a projectile-receiving adapter matched to and receiving the projectile integrated within the wound package in the adaptation region for the projectile.

* * * * *